US011490678B2

(12) United States Patent
Bentz

(10) Patent No.: US 11,490,678 B2
(45) Date of Patent: Nov. 8, 2022

(54) BOOT COVER

(71) Applicant: Abbi Bentz, Wellington, FL (US)

(72) Inventor: Abbi Bentz, Wellington, FL (US)

( * ) Notice: Subject to any disclaimer, the term of this patent is extended or adjusted under 35 U.S.C. 154(b) by 0 days.

(21) Appl. No.: 17/084,589

(22) Filed: Oct. 29, 2020

(65) Prior Publication Data

US 2022/0132976 A1 May 5, 2022

(51) Int. Cl.
*A43B 5/18* (2006.01)
*A43B 5/00* (2022.01)

(52) U.S. Cl.
CPC ..... *A43B 5/006* (2013.01); *A43B 5/18* (2013.01)

(58) Field of Classification Search
CPC ..... A43B 5/18; A43B 5/006; A43C 17/00; A43C 17/02; A43C 17/04; A43C 17/06
See application file for complete search history.

(56) References Cited

U.S. PATENT DOCUMENTS 82,921 A * 10/1868 Cooper ..... A43C 17/00 54/83.1
111,880 A * 2/1871 Schwandt ..... A43C 17/00 54/83.2
587,483 A * 8/1897 Hill ..... A43B 23/047 36/51
916,061 A * 3/1909 Thorsch ..... A43B 23/28 36/58.5
1,651,631 A * 12/1927 Radway ..... A43B 3/16 36/7.4
1,837,518 A * 12/1931 Blair ..... A43B 3/16 36/14
2,438,978 A * 4/1948 Rosen ..... A43C 17/02 36/1
2009/0083997 A1* 4/2009 Edwards ..... A43B 5/006 36/89
2018/0271220 A1* 9/2018 Schulten-Gaywood ..... A41D 17/005

FOREIGN PATENT DOCUMENTS

GB 2516042 A * 1/2015 ..... A43B 5/006

* cited by examiner

*Primary Examiner* — Ted Kavanaugh
(74) *Attorney, Agent, or Firm* — Tucker Law; Matthew Sean Tucker, Esq.

(57) ABSTRACT

An equestrian boot cover for protecting against the elements and extending the life of an equestrian riding boot comprising a cover body and a neck extending the height of the equestrian riding boot for forming a snug fit against the outer surface of the equestrian riding boot and including a spur aperture for allowing passage of the spur from about the equestrian boot cover.

11 Claims, 8 Drawing Sheets

BOOT COVER

FIELD OF THE INVENTION

The present invention relates to a boot cover, and more particularly to a boot cover for equestrian riding boots.

BACKGROUND OF THE INVENTION

Equestrian boots are generally made for horseback riding. Equestrian boots typically are high enough to prevent a horse saddle from pinching the leg of a horseback rider, and has a heel to prevent the feet of a horseback rider from sliding through the stirrup.

Equestrian boots are expensive footwear and are regularly exposed to water, dirt and mud while riding horses and while walking at equestrian facilities, including through barns and stables. There are no existing boot protectors that would be sufficient to protect an equestrian boot while horseback riding.

Accordingly, a need exists to protect the longevity of equestrian boots against the elements.

SUMMARY OF THE INVENTION

The present invention advantageously provides an equestrian boot cover for protecting against the elements and extending the life of an equestrian riding boot comprising a cover body and a neck extending the height of the equestrian riding boot for forming a snug fit against the outer surface of the equestrian riding boot and including a spur aperture for allowing passage of the spur from about the equestrian boot cover.

According to an embodiment of the present invention, a principal object is to provide a boot cover for equestrian riding boot comprising a flexible elastic shoe cover including a cover body and a neck, the cover body includes a toe portion, a vamp portion, a heel counter portion, and a bottom portion, the bottom portion includes a lower gripping surface capable of engaging a stirrup on an outward facing side and the lower gripping surface engages a boot sole and a boot heel on an inward facing side for fully encapsulating the lower portion of a boot, the neck extending from the top of the cover body, the neck terminating along an upper neck edge, and an spur aperture about the heel counter portion.

According to an embodiment of the present invention, another object is to provide an aperture constructed and arranged to snuggly form against a boot spur to allow a portion of the spur to penetrate through the boot cover.

According to an embodiment of the present invention, another object is to provide a flexible rubberized elastic shoe cover including a central slit extending from the vamp portion to the upper neck edge.

According to yet another embodiment of the present invention, another object is to provide a central slit that forms an outer portion and an inner portion. The embodiment is provided as a mirror image depending on whether the boot cover is for a left or right equestrian boot.

According to an embodiment of the present invention, another object is to further provide a zipper attached along the central slit to allow a user to zip the boot cover open and closed, when the zipper is in the open position the user can slip a boot in and out of the boot cover and when the zipper is in the closed position, the boot cover fits snuggly against the equestrian boot fully and/or substantially covering the equestrian boot.

According to an embodiment of the present invention, another object is to further provide a cover body and neck that each snuggly forms against the equestrian boot when the zipper is closed.

According to a non-limiting embodiment of the present invention, another object is to further provide the flexible rubberized elastic shoe cover formed of a single continuous material.

According to another embodiment of the present invention, another object is to further provide that the zipper extends from an upper neck edge to a toe portion of the boot cover.

According to yet another embodiment of the present invention, another object is to further provide a shoe cover that engulfs the entire equestrian boot revealing only the spur.

Other objects will become evident as the present invention is described in detail below.

BRIEF DESCRIPTION OF THE DRAWINGS

Embodiments of the present application are described herein in which similar elements are given similar reference characters, and a more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
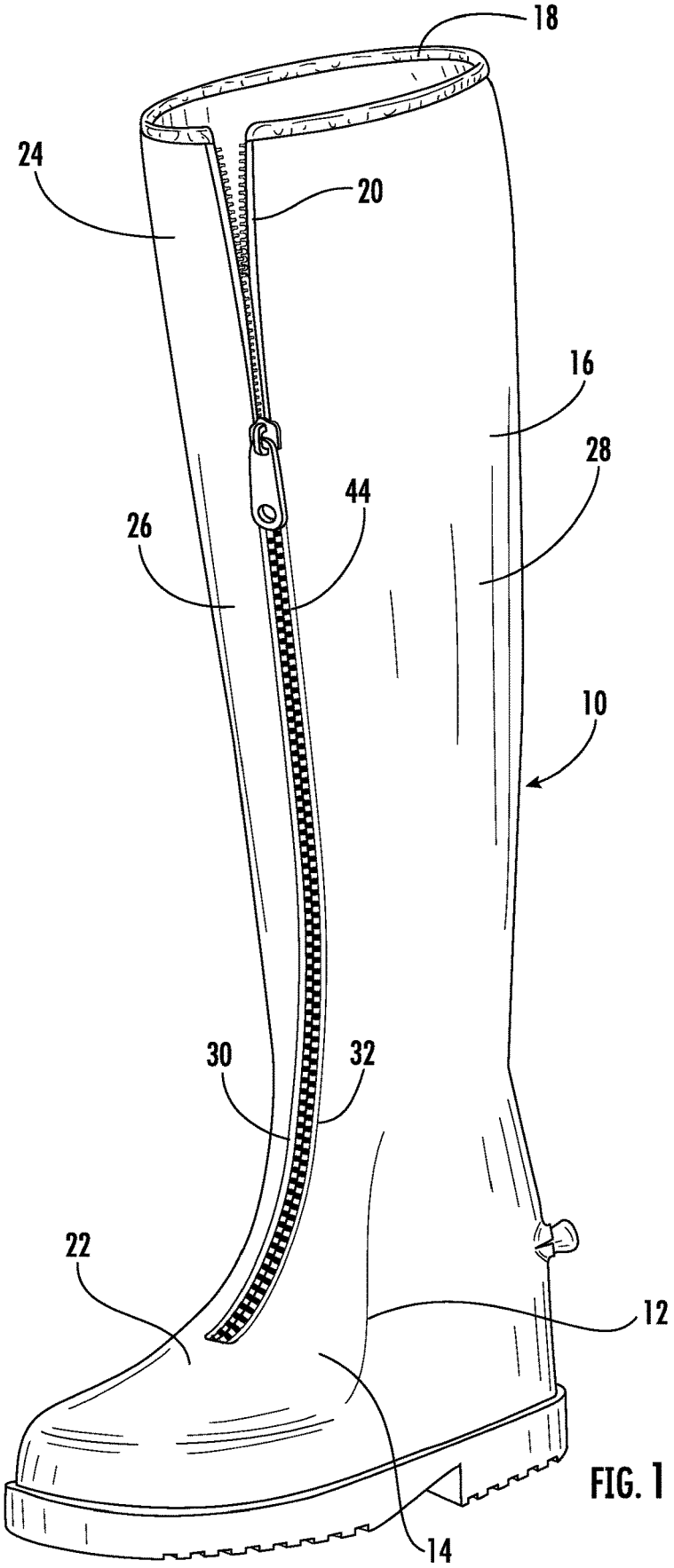
FIG. 1 is a side perspective view of a boot cover of one embodiment of the present invention.

The present invention advantageously provides a boot cover for an equestrian boot. The present invention contemplates various types of boot covers and the drawings display a left boot cover, and are mirrored to be accomplished as a right boot cover for a right boot.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Referring now to the drawings figures in which like reference designators refer to like elements. FIG. 1 shows an exemplary boot cover constructed in accordance with the principles of the present invention and designated generally as boot cover 10.

The boot cover 10 is sized and shaped to provide a snug fit with an equestrian riding boot. The boot cover 10 is formed of at least partially stretchable material constructed and arranged to contour the shape of an equestrian boot that is worn under the boot cover 10.

When the boot cover 10 is engaged with an equestrian boot, the cover provides a sleek and high quality appearance that protects against the elements to keep the expensive equestrian boots from exposure to elements, such as dirt and mud.

The boot cover 10 includes a cover body 12. The cover body 12 is formed of a lower portion 14 and a neck 16 terminating along an upper edge 18. The cover body 12 includes a central slit 20 that ends from a portion of the vamp 22 to the collar 24. The central slit 20 separates at least a portion of the inner portion 26 and the outer portion 28 along their inner edges 30, 32. In a non-limiting embodiment, the inner edges 30, 32 includes a zipper 44 for closing the inner edges 30, 32 around an equestrian boot. While the instant embodiment includes a zipper 44, the zipper 44 may be replaced with an alternative closure mechanism including without limitation laces, buttons, or hook and loop material.

Figure 2:
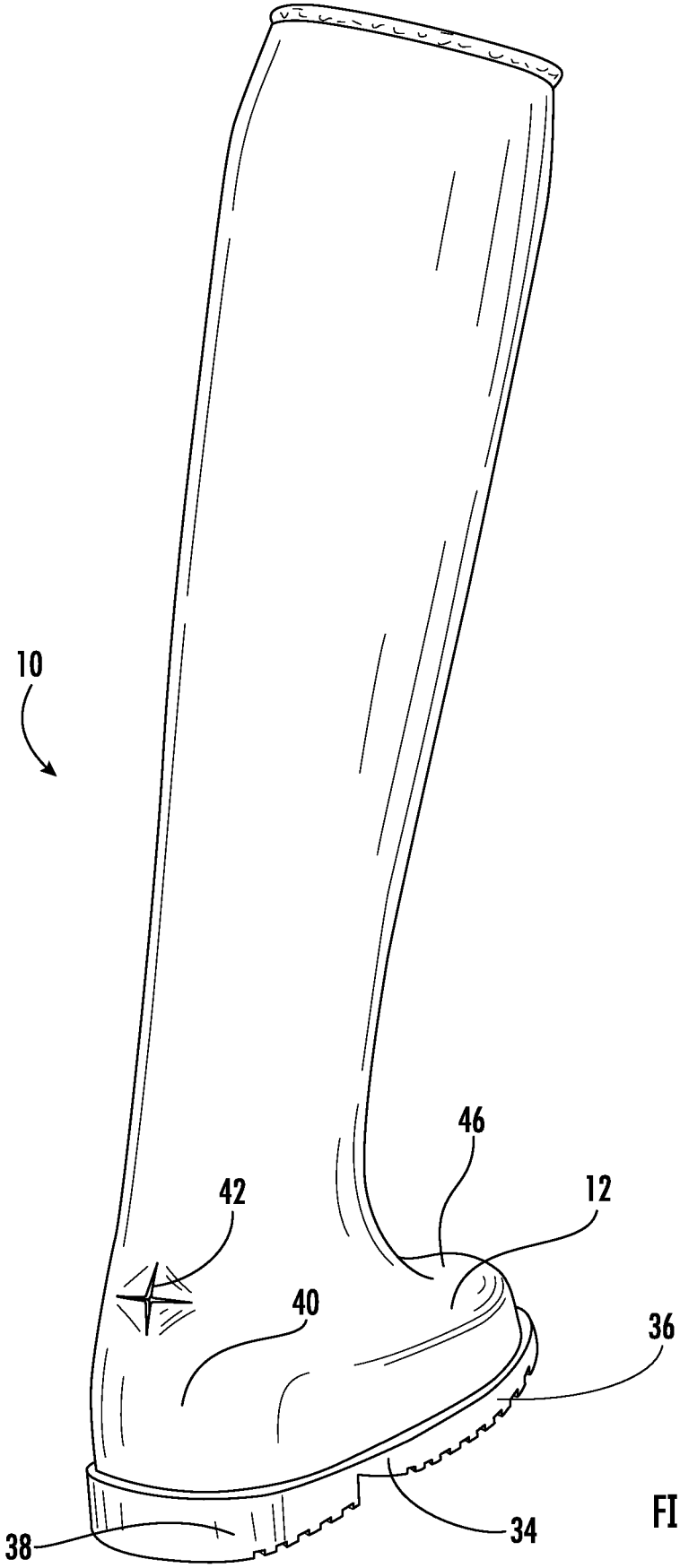
FIG. 2 is a rear perspective view of the boot cover without an engaged spur in accordance with the principles of the present embodiment.

Referring now to FIG. 2, the cover body 12 of the boot cover 10 includes a bottom cover portion 34. The bottom cover portion 34 includes a sole cover portion 36 and a heel cover portion 38. The bottom cover portion 34 is constructed to fully cover the sole and heel of an equestrian boot.

Figure 3:
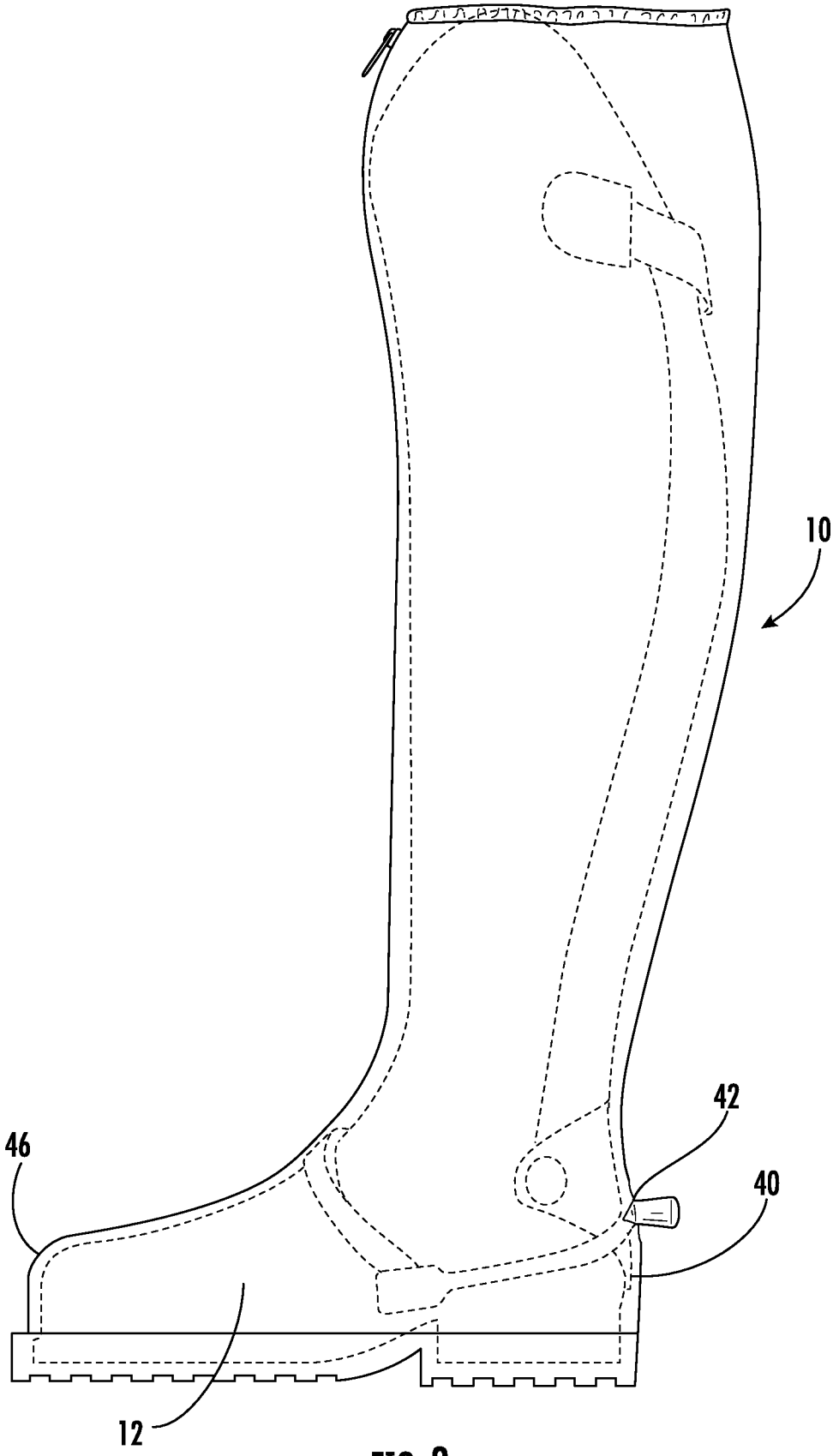
FIG. 3 is a left side view of the boot cover of FIG. 1 in accordance with the principles of the present embodiment.
Figure 4:
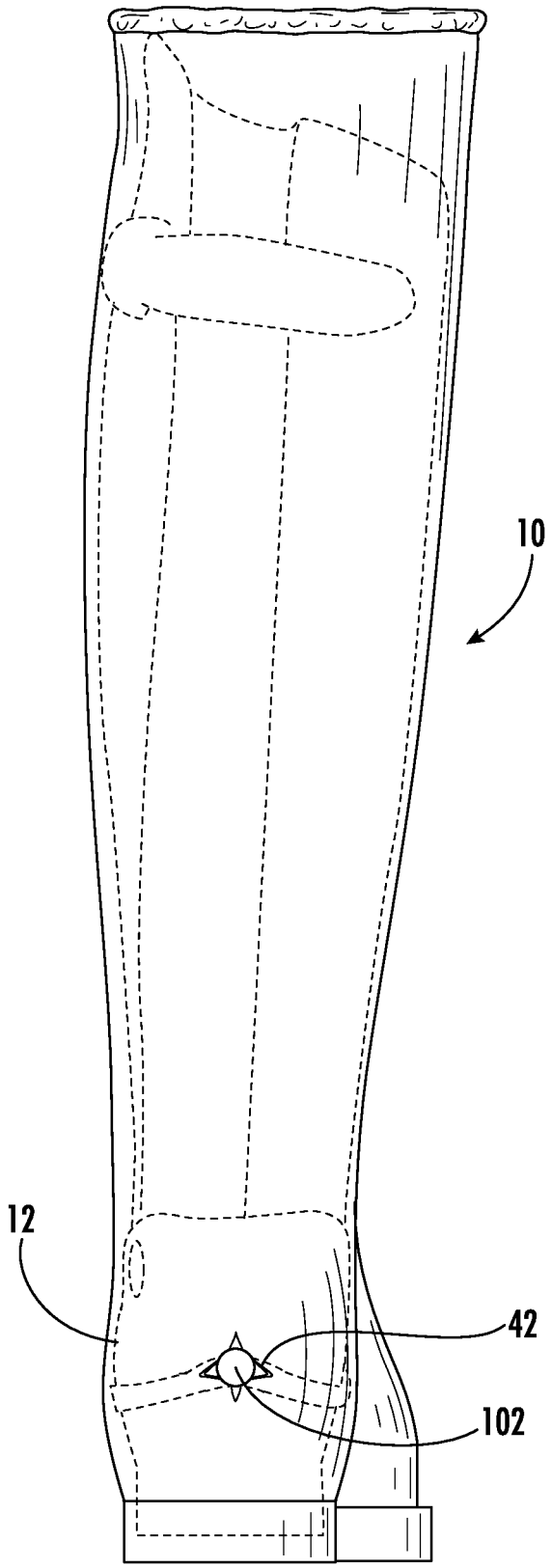
FIG. 4 is a rear view of the boot cover of FIG. 1 in accordance with the principles of the present embodiment
Figure 5:
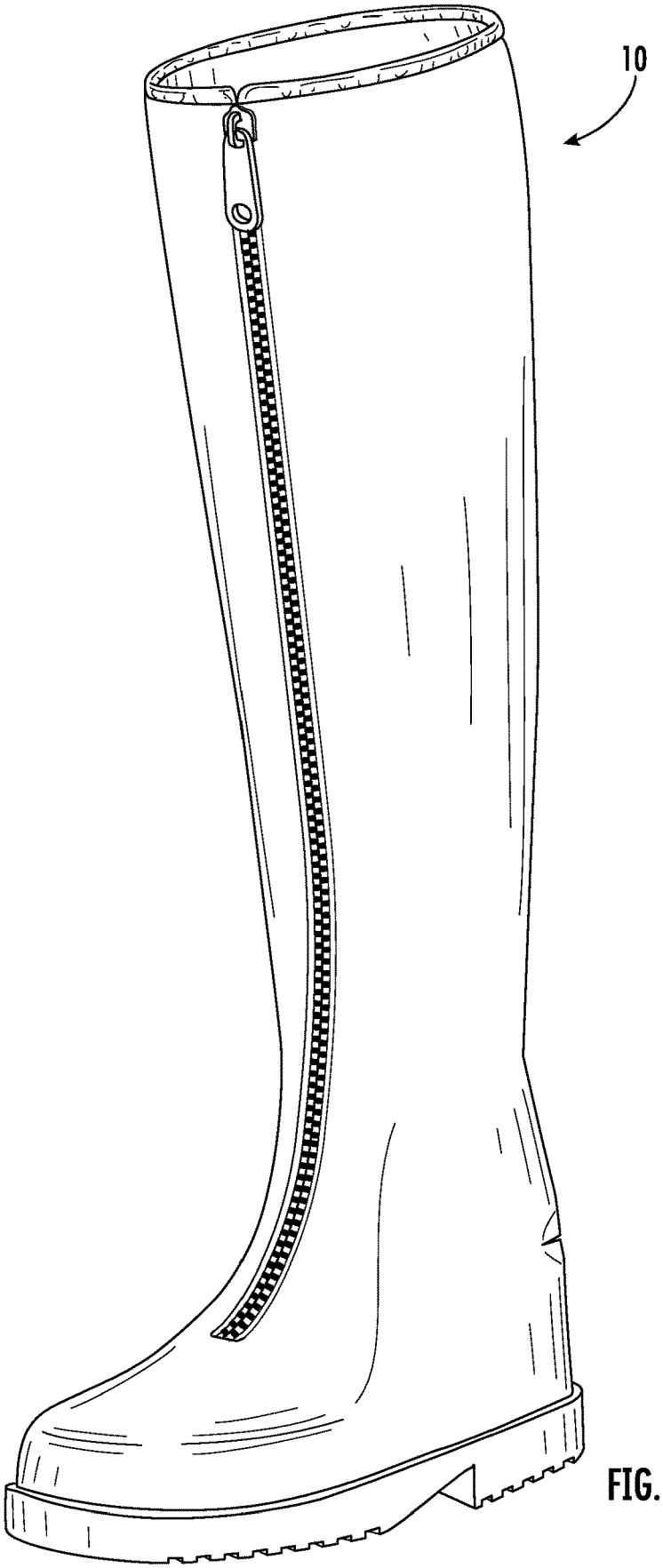
FIG. 5 is a side perspective view of a boot cover with a zipper in the closed position in accordance with the principles of the present embodiment.
Figure 6:
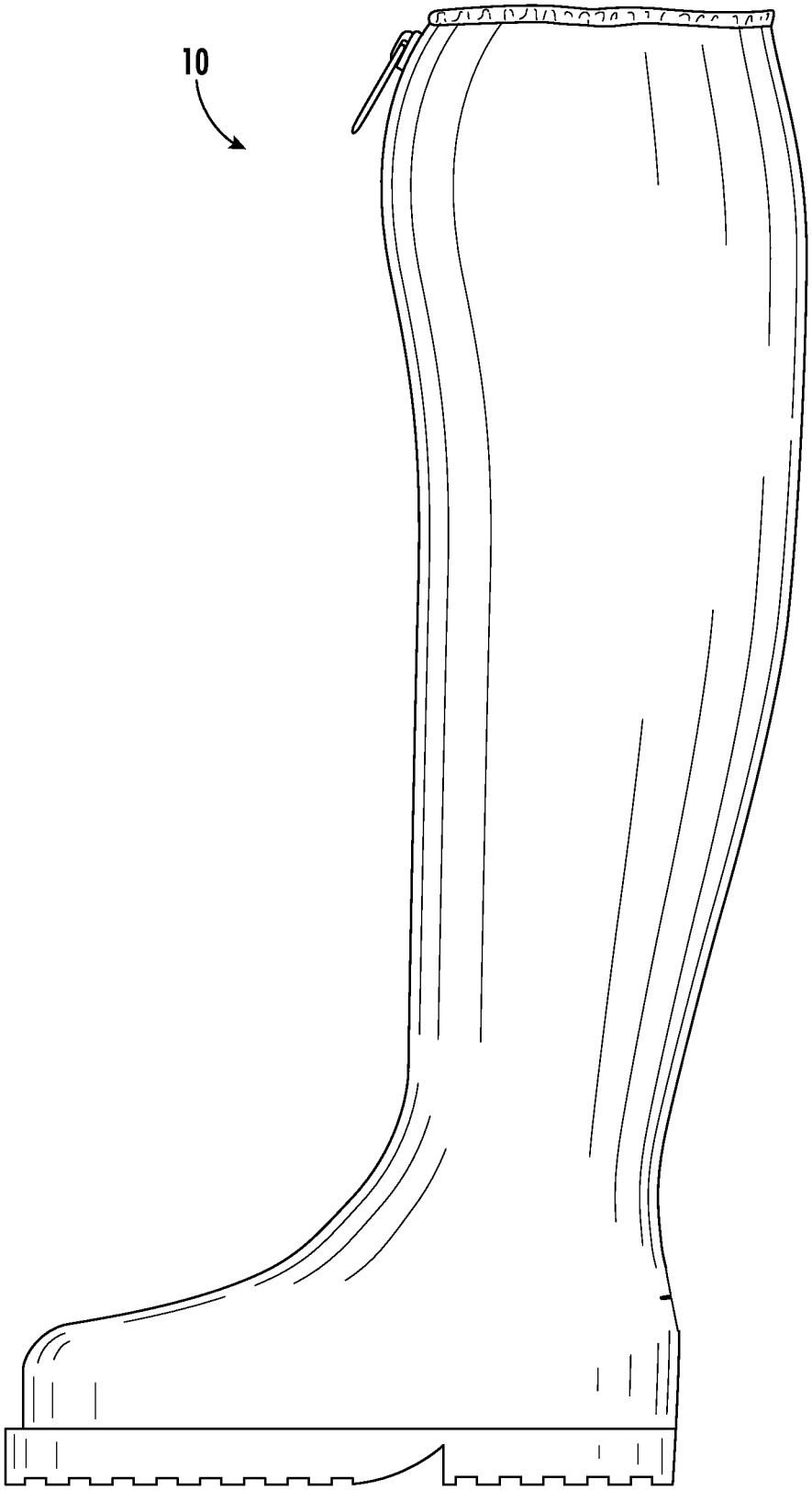
FIG. 6 is a side view of a boot cover in accordance with the principles of the present embodiment.
Figure 7:
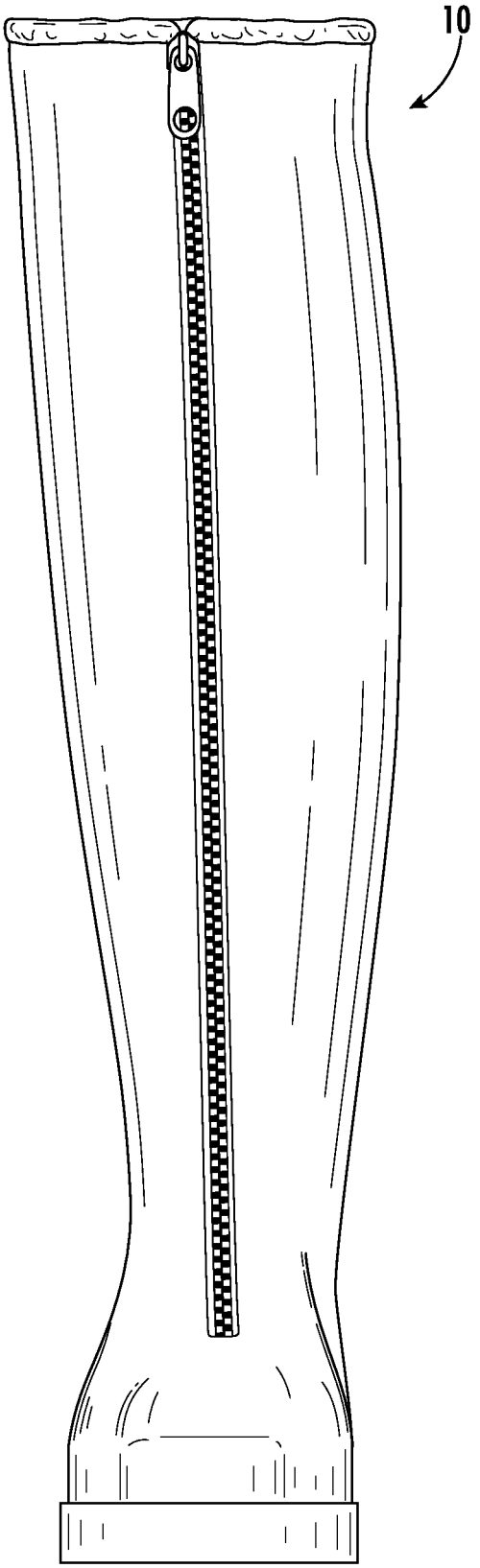
FIG. 7 is a front view of a boot cover in accordance with the principles of the present embodiment.
Figure 8:
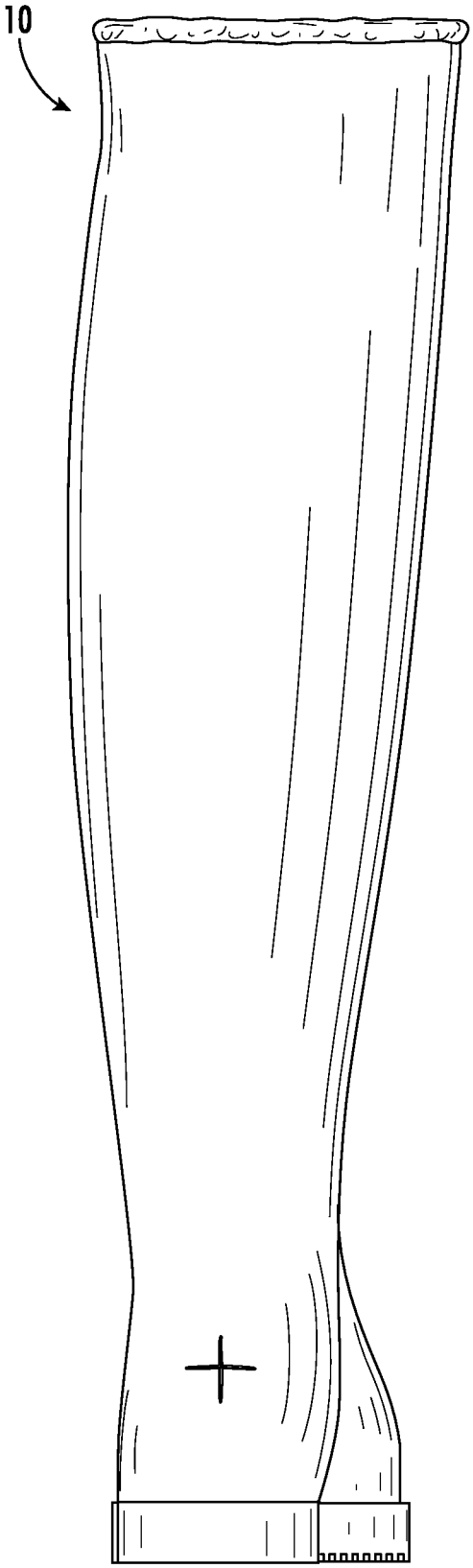
FIG. 8 is a rear view of a boot cover in accordance with the principles of the present embodiment.
Figure 9:
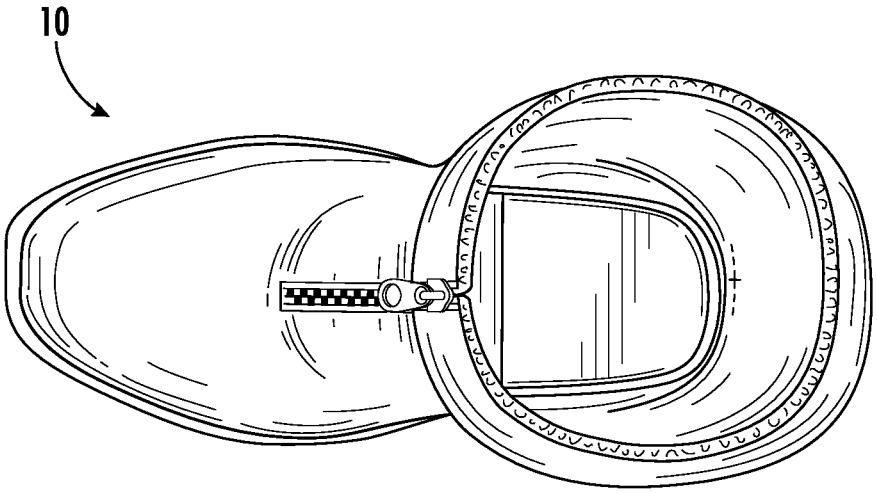
FIG. 9 is a top view of a boot cover in accordance with the principles of the present embodiment.
Figure 10:
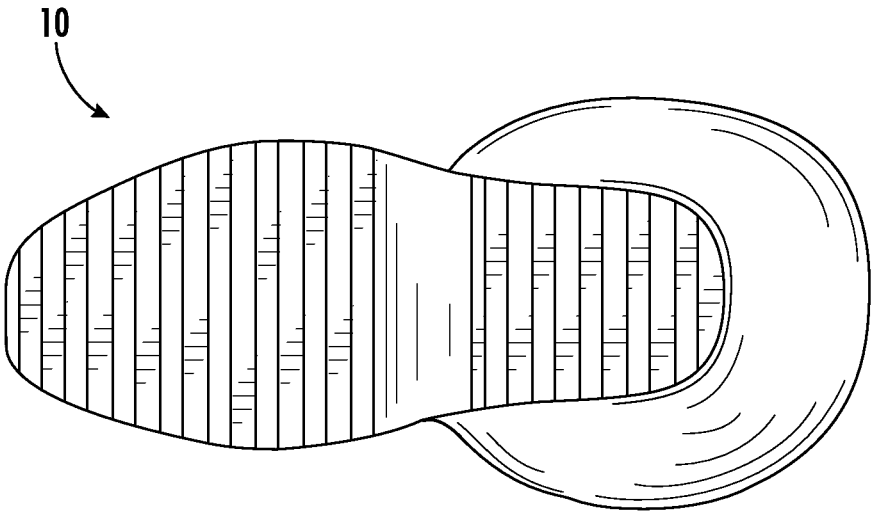
FIG. 10 is a bottom view of a boot cover in accordance with the principles of the present embodiment.

Referring now to FIGS. 2-4, the cover body 12 of the boot cover 10 includes a heel counter portion 40 opposite the toe portion 46. The heel counter portion 40 includes a fitted opening 42. The fitted opening 42 allows a boot spur 102 to position therethrough (See FIGS. 3-4).

The boot cover 10 illustrated in FIGS. 1-4 provide for the zipper 44 along the front portion of the boot cover 10, alternatively the zipper 44 could be positioned on the inner or outer side of the boot cover 10 or the rearward portion of the boot cover 10. When the zipper 44 is positioned on the rearward portion of the boot cover 10, the zipper extends from the upper edge 18 of the fitted opening 42 to the upper edge 18.

Referring now to FIGS. 5-10 provide the boot cover 10. with the zipper in the closed position.

As used herein, when the term "and/or" is used, it shall include all combinations of one or more of the associated described items.

While the instant embodiment depicts a left boot cover for a left boot, it is fully with the spirit and scope of the present invention to mirror the drawings to make an identical right boot cover for a right boot.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are contemplated in light of the above teachings without departing from the scope and spirit of the invention. It will be readily apparent that various changes may be made thereto without departing from the spirit and scope of the disclosure or sacrificing all of its material advantages. The examples and embodiments described herein are merely exemplary of the instant disclosure.

What is claimed is:

1. A boot cover for an equestrian riding boot comprising:

a flexible rubberized elastic shoe cover of a single continuous material including a cover body and a neck;

said cover body having an outward facing surface and an inner facing surface, said cover body including a toe portion, a vamp portion, a heel counter portion, and a bottom portion wherein said single continuous material extends to said vamp portion, said heel counter portion, and said bottom portion;

said bottom portion including a lower gripping surface on said outward facing surface, wherein said lower gripping surface formed to engage a stirrup with said outward facing side, and said inner facing surface formed to engage a boot sole and a boot heel;

said neck extending from a top of said cover body, said neck terminating along an upper neck edge; and a spur aperture about said heel counter portion, said spur aperture extending from said outward facing surface to said inner facing surface for allowing passage of the spur.

2. The boot cover for equestrian riding boots of claim 1 wherein said spur aperture is formed to snuggly form against a boot spur.

3. The boot cover for equestrian riding boots of claim 2 wherein said flexible rubberized elastic shoe cover including a central slit extending from said vamp portion to said upper neck edge.

4. The boot cover for equestrian riding boots of claim 3 wherein said central slit forms an outer portion and an inner portion.

5. The boot cover for equestrian riding boots of claim 4 further comprising a zipper attached along said central slit.

6. The boot cover for equestrian riding boots of claim 5 wherein said cover body snuggly forms against an equestrian boot when said zipper is closed.

7. The boot cover for equestrian riding boots of claim 5 wherein said neck snuggly forms against an equestrian boot when said zipper is closed.

8. The boot cover for equestrian riding boots of claim 6 wherein said aperture is formed in at least a horizontal orientation between the width of the boot cover.

9. The boot cover for equestrian riding boots of claim 5 wherein said zipper extends from said upper neck edge to said toe portion.

10. The boot cover for equestrian riding boots of claim 9 wherein said shoe cover is formed to engulf an entire equestrian boot revealing only the spur of said equestrian boot.

11. A boot cover for equestrian riding boot comprising:

a flexible rubberized elastic shoe cover of a single continuous material including a cover body and a neck;

said cover body having an outward facing surface and an inner facing surface, said cover body including a toe portion, a vamp portion, a heel counter portion, and a bottom portion wherein said single continuous material extends to said vamp portion, said heel counter portion, and said bottom portion;

said bottom portion including a lower gripping surface on said outward facing surface, wherein said lower gripping surface formed to engage a stirrup with said outward facing side, and said inner facing surface formed to engage a boot sole and a boot heel;

said neck extending from the top of said cover body, said neck terminating along an upper neck edge;

an spur aperture about said heel counter portion, said spur aperture extending from said outward facing surface to said inner facing surface;

a zipper attached along a central slit;

wherein said spur aperture constructed and arranged to snuggly form against a boot spur;

wherein said flexible rubberized elastic shoe cover including said central slit extending from said vamp portion to said upper neck edge;

wherein said central slit forms an outer portion and an inner portion;

wherein said cover body snuggly forms against the equestrian boot when the zipper is closed;

wherein said neck snuggly forms against the equestrian boot when the zipper is closed;

wherein said flexible rubberized elastic shoe cover formed of a single continuous material; and wherein said shoe cover engulfs the entire equestrian boot capable revealing only the spur extendable through said spur aperture.

* * * * *